US005093195A

United States Patent [19]

Thompson, Jr.

[11] Patent Number: 5,093,195

[45] Date of Patent: Mar. 3, 1992

[54] PROCESS FOR PREPARING NYLON STAPLE FIBER

[75] Inventor: Alfred H. Thompson, Jr., Seaford, Del.

[73] Assignee: E. I. Du Pont de Nemours and Company, Wilmington, Del.

[21] Appl. No.: 674,920

[22] Filed: Mar. 26, 1991

Related U.S. Application Data

[63] Continuation of Ser. No. 347,052, May 4, 1989, Pat. No. 5,011,645.

[51] Int. Cl.[5] ..... D02G 3/00; D02G 3/04; D02G 3/44

[52] U.S. Cl. ..... 428/359

[58] Field of Search ..... 428/359

[56] References Cited

U.S. PATENT DOCUMENTS

| | | | |
|---|---|---|---|
| 3,044,250 | 7/1962 | Hebeler . | |
| 3,188,790 | 6/1965 | Hebeler | 57/140 |
| 3,311,691 | 3/1967 | Good | 264/235.6 |
| 3,321,448 | 5/1967 | Hebeler | 260/78 |
| 3,459,845 | 8/1969 | Hebeler | 264/168 |
| 3,651,201 | 3/1972 | Brignac et al. | 264/235.6 |

FOREIGN PATENT DOCUMENTS

| | | | |
|---|---|---|---|
| 21596 | 12/1966 | Japan | 264/346 |

*Primary Examiner*—James C. Cannon

[57] ABSTRACT

Nylon staple fiber (and precursor continuous filaments in the form of a tow) of high load-bearing capacity is prepared by an improved process of first drawing the tow between multiple feed and draw rolls, followed by both heating and cooling the draw filaments to anneal them under a controlled tension.

2 Claims, 3 Drawing Sheets

PROCESS FOR PREPARING NYLON STAPLE FIBER

This is a continuation of application Ser. No. 07/347,052, filed May 4, 1989, now U.S. Pat. No. 5,011,645.

FIELD OF THE INVENTION

This invention concerns improvements relating to nylon staple fiber, and more particularly its preparation, especially in the drawing and annealing of filamentary tows, and to the resulting annealed products, including uncrimped staple fiber cut from the annealed continuous filamentary tows.

BACKGROUND OF THE INVENTION

Nylon has been manufactured and used commercially for about fifty years. The first nylon fibers were of nylon 66, poly(hexamethylene adipamide), and nylon 66 fiber is still made and used as the main nylon fiber in the USA; large quantities of other nylon fibers, especially of nylon 6 fiber, from caprolactam, are also made and used, especially in some other countries. Nylon fiber is used in textile fabrics, and for other purposes. For textile fabrics, there are essentially two main fiber categories, namely continuous filament yarns and staple fiber, i.e. cut fiber. Large amounts of nylon filaments are used in small bundles of filaments, without cutting, i.e. as continuous filament yarn, e.g. in hosiery, lingerie and many silk-like fabrics based on continuous filament yarns; the present invention is not concerned with these continuous filament yarns, but with nylon staple fiber, and its precursor tow, which is prepared by very different equipment, and which requires entirely different handling considerations because of the large numbers of filaments that are handled. Nylon staple fiber has been made by melt-spinning nylon polymer into filaments, collecting very large numbers of these filaments into a tow, which usually contains many thousands of filaments and is generally of the order of several hundred thousand in total denier, and then subjecting the continuous tow to a drawing operation between a set of feed rolls and a set of draw rolls (operating at a higher speed) to increase the orientation in the filaments, often with an annealing operation to increase the crystallinity, especially if stretch nylon is not desired, and sometimes followed by crimping the filaments, before converting the tow to staple fiber, e.g. in a staple cutter. One of the advantages of staple fibers is that they are readily blended, particularly with natural fibers, such as cotton (often referred to as short staple) and/or with other synthetic fibers, to achieve the advantages derivable from blending, and this blending may occur before the staple cutter, or at another stage, depending on process convenience.

A particularly desirable form of nylon staple fiber has been used for many years for blending with cotton, particularly to improve the durability and economics of the fabrics made from the blends of cotton with nylon, because the nylon staple fibers have a high load-bearing tenacity, as disclosed in Hebeler, U.S. Pat. Nos. 3,044,250, 3,188,790, 3,321,448 and 3,459,845, the disclosures of which are hereby incorporated by reference. As explained by Hebeler, the load-bearing capacity is conveniently measured as the tenacity at 7% elongation ($T_7$), and the $T_7$ has long been accepted as a standard measurement, and is easily read on an Instron machine.

(All measurements herein are made on single staple fiber, unless otherwise indicated, taking appropriate care with the clamping of the short fiber, and making an average of measurements on at least 10 fibers; in most of the Examples herein at least 3 sets of measurements (each for 10 fibers) were averaged together to provide the data that is recorded). Hebeler's process involved drawing the nylon fibers to the maximum operable draw ratio, and subjecting them to a heat treatment under drawing tension for at least 1 second at the maximum operable temperature. (The draw ratio is the ratio of the higher speed of the draw rolls to the lower speed of the feed rolls). Of the four Hebeler patents, the last, i.e. U.S. Pat. No. 3,459,845, claimed the process, by drawing and heat-treating the filaments under drawing tension at 165° to 200° C. for a length of time which provided 1,000 to 6,000 degree-seconds exposure, the filaments being drawn and heat-treated under dry conditions at substantially the maximum operable draw ratio within the range of about 3 to 5 which can be used without excessive filament breakage, feeding the drawn filaments to the staple cutter without crimping, and cutting the uncrimped filaments into staple fiber. For convenience, I shall refer to this heat-treating using the conventional term "annealing". Hebeler showed in his Table 1 various operating conditions that he used, and in his Table 2 the properties of the filaments produced under his various conditions, measured as indicated by Hebeler (although Hebeler refers to "yarn", it is clear that Hebeler was not referring to spun yarn, but to the continuous filaments from his tows), and in his Table 3 the Lea Product values for spun yarns of nylon, with cotton, or other fibers. Since then, further refinements and improvements have been made so that the commercially-available uncrimped nylon staple fiber has had the following typical properties, tenacity (hereinafter "T") 6.8 grams per denier (gpd), elongation to break (hereinafter "$E_B$") 47%, and $T_7$ 2.4–2.5 gpd. These products have been made by a process essentially as described by Hebeler, and illustrated in Hebeler's FIG. 1 (and also shown schematically in FIG. 1 herein, as described more particularly below), at a speed of 110 ypm (yards per minute), this being the optimum practical speed of the draw rolls that deliver the drawn tow in Hebeler's process. (References to speeds in textile processes have generally been to the speed at which the final product is produced, unless otherwise indicated; all speeds herein are given in ypm unless otherwise indicated). It has long been desirable to increase this speed without significant detriment to the properties that are desired, but this has not been possible consistently with the existing process. Indeed, the filaments begin to break at higher speeds, and the number of breaks becomes excessive if the speed is increased significantly beyond about 130 ypm, to the extent that the process as a whole becomes inoperable.

So, a main object of the present invention is to increase the speed of the process without significant loss of properties in the resulting product. This has long been desirable.

It would also be advantageous to be able to improve the desirable properties, e.g. the $T_7$, as this would give greater flexibility, e.g. in blending, for instance enabling yarns to be prepared with equivalent strength (for the blends) while reducing the amount of nylon. In this regard, it should be explained that, since the time of Hebeler's original disclosures, it has proved possible to improve and select the properties of cotton fibers, e.g.

to obtain a $T_7$ for cotton up to as much as 2.5 gpd, or even more by careful selection.

BRIEF SUMMARY OF THE INVENTION

According to one aspect of the invention, there is provided a process for preparing nylon staple fibers having high load-bearing tenacity, including the steps of melt-spinning nylon polymer into filaments, forming a tow from a multiplicity of the resulting filaments, subjecting the tow to drawing and annealing, and converting the tow into staple fiber suitable for forming into spun yarn, if desired, blended with other staple fibers, wherein the drawing and annealing of the tow is carried out in a continuous operation consisting essentially of first drawing the tow between a set of feed rolls, that are driven at lower speeds, and a set of draw rolls, that are driven at higher speeds, followed by annealing the resulting drawn tow by heating it to a temperature of about 145° C. to about 200° C., and cooling it to less than about 80° C., while maintaining the drawn tow under a controlled tension throughout both said heating and said cooling steps as the tow is advanced by a further set of tension rolls through this annealing stage. These further tension rolls are sometimes referred to as annealing rolls herein, since their speed controls the tension during the annealing stage. These (annealing) tension rolls are preferably driven at a speed at least as high as that of the draw rolls, and especially slightly faster than the draw rolls. The ratio of the speed of the annealing rolls to the speed of the draw rolls is referred to as the Annealing Ratio, and is expressed as a percentage, i.e. AR%, herein.

By use of the novel process of the invention, it has been possible to increase the speed substantially, without significant loss of desirable properties. It has also proved possible to obtain nylon staple fiber having an improved combination of desirable properties, such as has not been previously practicable. Thus, according to another aspect of the invention, there is provided nylon staple fiber of T about 6.8 gpd, or more, and of $T_7$ at least about 2.75, preferably about 2.75 to about 3.2, and generally of the order of about 3 gpd, when measured consistently over a long period. These are significantly higher than previously practicable.

DETAILED DESCRIPTION OF THE INVENTION

Figure 1:
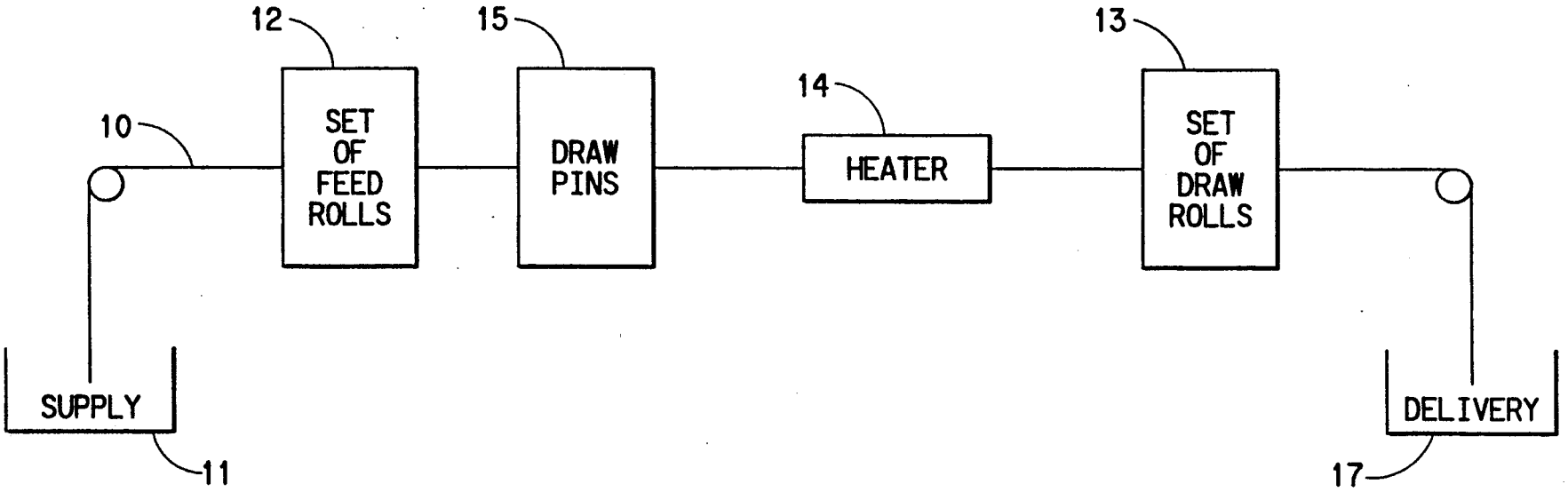
FIG. 1 (PRIOR ART)
FIG. 1 is a schematic box diagram showing the sequence of process operations used in the existing commercial process, i.e. essentially as disclosed by Hebeler.

The processes illustrated in FIGS. 1 and 2 will be described in more detail hereafter, but it will be noted immediately from these Figures that an important difference is my location of the draw rolls before the heater in FIG. 2 according to the invention, instead of after the heater in FIG. 1 as shown by Hebeler. Thus, Hebeler had maintained his drawing tension throughout his annealing heat treatment by using only 2 sets of driven rolls, and locating his draw rolls after his annealing equipment, i.e. the heater. In contrast, the process of the invention provides a clear demarcation between the drawing step and the subsequent annealing step, which need not necessarily be carried out using the same speeds, so that I can control the tension during my annealing step independently of the tension during my drawing step. Furthermore, in the process of the invention, my annealed filaments are thoroughly cooled while maintaining the annealing tension.

The existing commercial process is now described in more detail with reference to the schematic box diagram illustrated in FIG. 1. The similarity to FIG. 1 of the Hebeler patents, e.g. U.S. Pat. No. 3,044,250, will be noted. As illustrated in FIG. 1 of the present case, a heavy denier tow 10 of undrawn nylon filaments from a supply, indicated generally as 11, is arranged so that the filaments enter the draw machine as a flat band of filaments. The draw machine comprises first a multiple set of feed rolls 12 (corresponding generally to Hebeler's series of feed rolls 3 illustrated in FIG. 1 of the tow drawing machine of Hebeler) that pull the tow 10 from the supply 11. The filaments are drawn between the multiple set of feed rolls 12 and a multiple set of draw rolls 13 (corresponding generally to Hebeler's multiple set of draw rolls illustrated as 7 in FIG. 1 of the tow drawing machine in Hebeler). The draw rolls are driven at a higher speed than the feed rolls, the ratio of such speeds reflecting the draw ratio. The tow emerges as a flat band from the set of draw rolls as a drawn tow and passes to the delivery, indicated generally as 17, it being understood that the drawn tow may, if desired, be further processed in conventional fashion, e.g. as described in the various art, including Hebeler. Between the set of feed rolls 12 and the set of draw rolls 13, the filaments pass a heater 14, after passing draw pins 15 (also illustrated in FIG. 1 of Hebeler, respectively, as hot plate 6, and three fixed stainless steel draw pins 5). As disclosed in the art, the main intention for using draw pins, sometimes referred to as snubbing pins, was to localize the draw point. (I believe that some 80 to 90% of the drawing may indeed have taken place at the draw pins, but that some drawing (i.e. increase in orientation) probably occurred each time the nylon filaments were subjected to an increase in speed). In the commercial operation, the heater 14 was in fact a hot plate followed by an oven, indicated as preferred by Hebeler. In the commercial operation, the draw rolls 13 were chilled with cold water in conventional fashion to control the cooling of the filaments after they left the heater 14.

The operation of the drawing process according to the prior art as described and illustrated in FIG. 1 (and also in Hebeler) should be contrasted with the continuous drawing and annealing process according to the invention as described and illustrated with reference to my preferred embodiment in FIG. 2.

Figure 2:
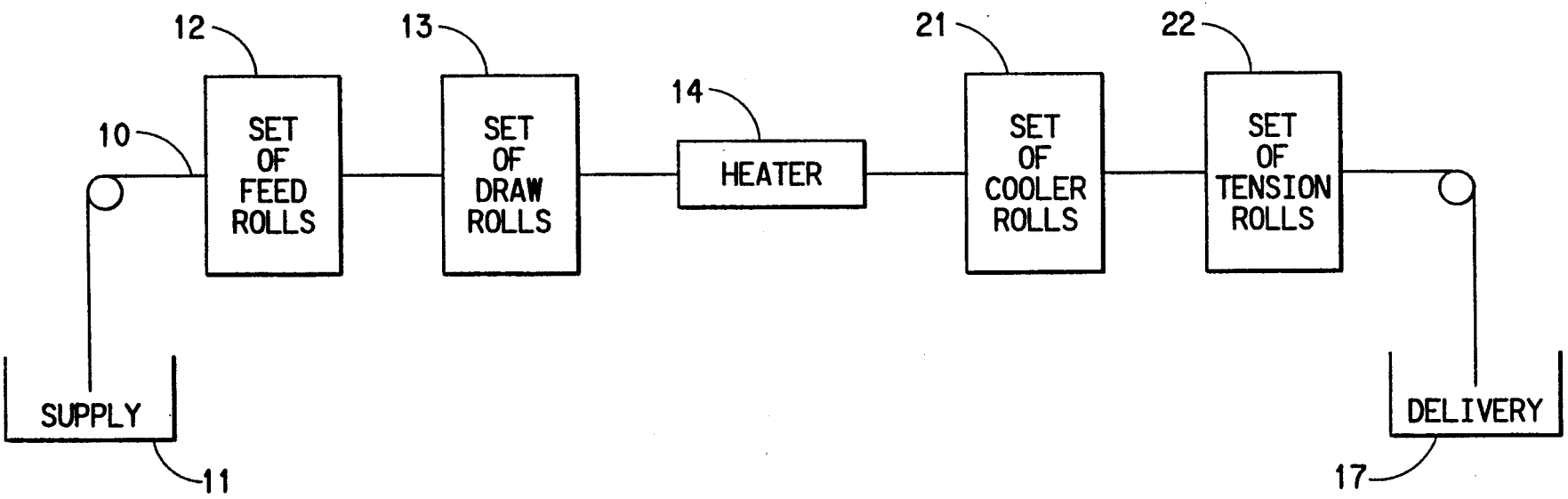
FIG. 2 is a schematic box diagram of the sequence of process steps according to a preferred process of the present invention.
Figure 3:
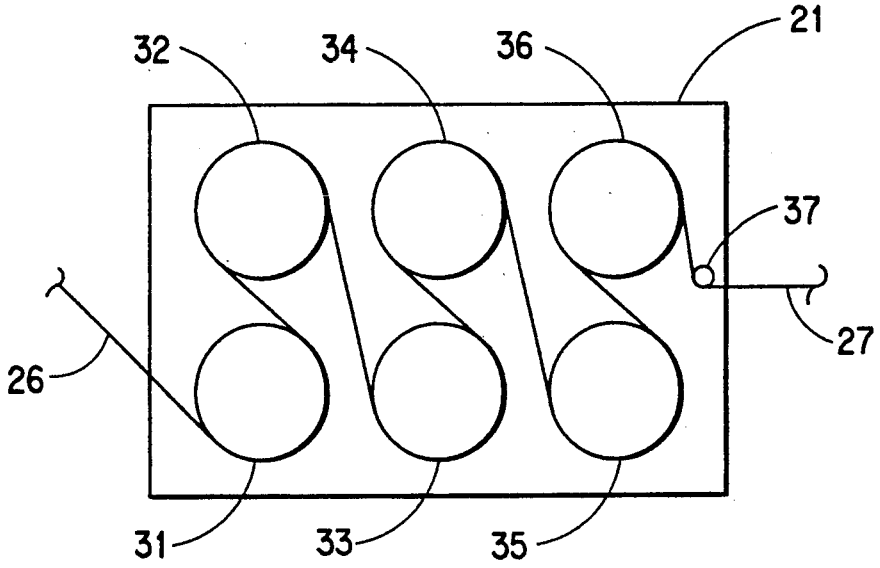
FIG. 3 is a side view in elevation of a set of cooler rolls that may be used in a process as described and illustrated in FIG. 2.

As illustrated in FIG. 2, an undrawn heavy denier tow 10 is pulled by a multiple set of feed rolls 12 from a supply 11, e.g. more or less as illustrated also in FIG. 1. However, after leaving the set of feed rolls 12, my tow passes directly to a multiple set of draw rolls 13, that are driven at higher speed. From the set of draw rolls 13, my tow (now drawn) passes to a heater, indicated generally as 14. The heated drawn tow emerging from heater 14 passes first to a set of cooler rolls 21 (also illustrated in FIG. 3) and then to a set of tension rolls 22 to become a cooled drawn tow that passes to the delivery 17. As illustrated in FIG. 3, the hot drawn tow passes in series a set of cooler rolls, indicated individually as 31, 32, 33, 34, 35 and 36, being shown arranged so that the filaments achieve maximum peripheral contact with each individual cooler roll, and then leaves the set of cooler rolls 21 as a cooled drawn tow after passing guide roll 37. It will be noted that my cooled drawn tow is still under a controlled tension as it passes from the set of cooler rolls 21 to the set of tension rolls 22.

Thus, an important difference is that the process of the present invention involves first a cold-drawing stage and then a distinct controlled annealing stage, instead of subjecting the filaments to the heat treatment (annealing) under the drawing tension. Thus my draw rolls 13 precede the heater 14 in the process of the present invention, as shown in FIG. 2, whereas Hebeler's draw rolls 7 pulled the tow past the heater 6. Also, I show in FIG. 2 three sets of driven rolls 12, 13 and 22, (whereas the cooler rolls 21 may be yarn-driven, if desired) so that the speeds and tensions in my 2 zones (drawing and annealing) may be separately controlled and adjusted, whereas Hebeler subjected the filaments to the heat treatment under the drawing tension. Another important difference is that my annealed filaments are cooled while still under a controlled tension, whereas Hebeler did not teach controlling the tension during cooling.

The invention is further illustrated in the following Examples, using nylon 66 (which is preferred), the physical properties being measured with an Instron tester on single filaments of cut tow taken from the package, after conditioning the filaments for at least two hours at 70° F. (dry bulb) and 65% relative humidity ($T_7$ values were read at 8.4% elongation to compensate for slippage in the clamps). Details are given for the commercial product, as a basis for comparison, and to demonstrate the improvement that has been achieved by the present invention.

EXAMPLE 1

For the commercial product (made using a process as shown in FIG. 1) 66 nylon polymer (of 55 RV) was spun at 650 ypm and combined to form a large denier tow, to which finish was applied, and which was fed through the feed rolls at 29.6 ypm. It was pulled from the feed rolls over draw pins to a hot plate maintained at 200 ° C., and then through an oven maintained at 165°-175 ° C., being withdrawn from the oven by draw rolls at a tow speed (at the draw rolls) of 110 ypm, which represents a draw ratio of 3.72 X. Following drawing, the tow was packed in bales.

The tow was formed for the process of the invention in the same manner as described for the commercial product, and then (as shown in FIG. 2) the tow was passed through the feed rolls 12, at a speed of 75.3 ypm, to draw rolls 13, where the tow speed was 275 ypm. The drawn tow was passed over hot plates maintained at 190° C. and then through an oven maintained at 165 ° C. After leaving the oven, the tow was cooled by passing over the chilled cooler rolls 21 and was then fed to the tension rolls 22 where the yarn speed was 278 ypm for a total draw ratio of 3.69 X. The drawn (and annealed) tow is then packed in bales.

The physical properties reported in Table 1 are measured on filaments taken from tow prepared as described above.

TABLE 1

| Process Conditions | | | Product Properties | | | |
|---|---|---|---|---|---|---|
| Process | Draw Ratio | Speed (ypm) | dpf | T (gpd) | $T_7$ (gpd) | $E_B$ % |
| Commercial | 3.72 | 110 | 2.50 | 6.8 | 2.4 | 47 |
| Invention | 3.69 | 275 | 2.44 | 6.9 | 2.9 | 46 |

Thus, at a comparable total draw ratio, despite using a much higher drawing speed, the process of this invention can produce fiber with an appreciably higher $T_7$. In contrast, with the commercial process, the speed could not be increased because the properties began to deteriorate, and the tow broke excessively when the speed approached 130 ypm. 110 ypm has represented a practical upper limit for good continuity in the commercial process.

EXAMPLE 2

Example 2 shows some effects of varying total draw ratio and yarn speed in the process of this invention. An important consideration, as indicated in the Hebeler patents, has been the Lea product for nylon yarns blended with cotton. The Lea product values reported in Table 2 were measured on yarns containing 50% nylon and 50% cotton. For comparison, the Table includes data for the commercial product.

TABLE 2

| Process | Speed (ypm) | Draw Ratio | $T_7$ (g/d) | Lea Product |
|---|---|---|---|---|
| Invention | 215 | 3.65 | 2.5 | 2928 |
| Invention | 215 | 3.75 | 3.0 | 3073 |
| Invention | 335 | 3.65 | 2.4 | 2976 |
| Commercial | 110 | 3.72 | 2.4 | 2724 |

This Example shows that, even when the speed of my process has been increased from 215 to 335 ypm (i.e., about three times the speed of the existing commercial process), a $T_7$ similar to that of the commercial product has been obtained by using a total draw ratio of 3.65 X. Alternatively, the $T_7$ can be raised substantially by increasing the draw ratio. This has not been a practical option for the commercial process, for which a draw ratio of 3.72 X was used (in view of excessive breaks at a draw ratio of about 3.8 X); a $T_7$ of 2.4–2.5 had represented a practical upper limit for the commercial process.

The data in Table 2 also show the substantial improvements in Lea product which have been obtained by using staple made by the process of my invention vs. that obtained by using staple from the commercial process. These improvements in yarn strength were obtained even when the $T_7$ values were comparable with the $T_7$ of the commercial product.

EXAMPLE 3

Table 3 shows the effect on $T_7$ values or varying the relationship between the speed of the tension rolls 22 (sometimes referred to as the annealing rolls) and of the draw rolls 13, so as to vary the tension during the annealing (both the heat treatment and the subsequent cooling in the process of the invention). This is expressed in Table 3 as AR(%), i.e. an Annealing (speed) Ratio, as a percentage. The draw roll speed was maintained at 275 ypm, and the draw ratio was maintained at 3.65 X in this Example.

TABLE 3

| AR % | $T_7$ |
|---|---|
| 97 | 2.4 |
| 100 | 2.7 |
| 101 | 2.9 |
| 102 | 3.1 |
| 103 | 2.8 |
| 105 | 2.5 |

This shows that small changes in the amount of stretch during annealing can be very important in improving the $T_7$. Under these conditions, an AR of about 101–103% provided a $T_7$ above 2.75 gpd, and an AR of about 102% provided a $T_7$ above 3 gpd. The tow speed in the annealing zone should preferably be at least equal to the tow speed in the draw zone, and a slight stretch in the annealing zone is especially desirable, which is relatively surprising to me. (Hebeler did not control annealing tensions separately, but maintained the drawing tension during the subsequent annealing, by placing his draw rolls after his heat treatment zone).

EXAMPLE 4

A comparison of some Lea Product values for blended yarns is shown in Table 4, from which it can be seen that it is possible to get comparable, and even superior, strength to that obtainable with the commercial yarns (at 52.5% nylon content) by using less than 50% of nylon staple fiber according to the present invention. This is desirable and significant for certain end uses and for consumers who prefer to increase cotton content (or reduce nylon content).

TABLE 4

| Yarn Count | Commercial Product (52.5% nylon) | Invention (49.9% nylon) |
|---|---|---|
| 13 singles | 2840 | 2800 |
| 14 singles | 2880 | 2930 |
| 15.5 singles | 2750 | 2780 |

I claim:

1. Nylon staple fiber having a tenacity of at least about 6.8 gpd and a load-bearing capacity of at least about 2.75 gpd measured as tenacity at 7% elongation.

2. The nylon staple fiber of claim 1 wherein said load bearing capacity is between about 2.75 gpd and 3.2 gpd.

* * * * *